US006588348B2

(12) United States Patent
Nomura et al.

(10) Patent No.: US 6,588,348 B2
(45) Date of Patent: Jul. 8, 2003

(54) MOVABLE MONEY SAFE

(76) Inventors: Yasuhiro Nomura, 502 Maison Riviere, 2-15-13 Nishikawa, Amagasaki-shi, Hyougo-ken (JP); Kazuo Yano, 898-9 Shinmachi, Yamato Kooriyama-shi, Nara-ken (JP)

( * ) Notice: Subject to any disclaimer, the term of this patent is extended or adjusted under 35 U.S.C. 154(b) by 0 days.

(21) Appl. No.: 10/035,331

(22) Filed: Jan. 4, 2002

(65) Prior Publication Data

US 2002/0088381 A1 Jul. 11, 2002

(51) Int. Cl.[7] ..... E05G 1/00

(52) U.S. Cl. ..... 109/47; 109/58; 109/62; 109/65

(58) Field of Search ..... 109/45, 47, 50, 109/58.5, 59 R, 58, 62, 65

(56) References Cited

U.S. PATENT DOCUMENTS 283,120 A * 8/1883 Lauth et al. ..... 109/47 X
661,226 A * 11/1900 Post ..... 109/47 X
671,424 A * 4/1901 Nicolle ..... 109/47 X
1,759,129 A * 5/1930 McClintock et al. ..... 109/47 X
1,778,857 A * 10/1930 James ..... 109/47 X
1,863,040 A * 6/1932 Cisor ..... 109/47 X
1,954,667 A * 4/1934 Ernst ..... 109/47 X
4,022,137 A * 5/1977 Chiu ..... 109/47 X
4,625,658 A * 12/1986 Hodges ..... 109/47
4,942,954 A * 7/1990 Nesser et al. ..... 109/47 X
5,179,901 A * 1/1993 Adcock ..... 109/45
5,711,231 A * 1/1998 Couvrette et al. ..... 109/47 X
5,836,256 A * 11/1998 Senterfeit, Sr. ..... 109/47 X

* cited by examiner

*Primary Examiner*—Suzanne Dino Barrett
(74) *Attorney, Agent, or Firm*—Armstrong, Westerman & Hattori, LLP

(57) ABSTRACT

Disclosed is an inexpensive money safe which is safe against fire and the like and which can easily be utilized when necessary. A basement (10) for accommodating a movable money safe (1) is accommodated in the basement (10), and upper surface of the movable money safe (1) is covered with a fireproof lid (15) which is the same color as that of the floor (12), and if the movable money safe (1) is driven into the room interior (11) for utilizing the movable cylinder unit (20) which is operated with water pressure of running water to drive the movable money safe (1) into the room interior (11).

8 Claims, 3 Drawing Sheets

1(A)

1(B)

3(A)

3(B)

MOVABLE MONEY SAFE

BACKGROUND OF THE INVENTION

1. Field of the Invention

The present invention relates to a movable money safe movably provided between a money safe accommodating position and a money safe usable position and more particularly, to a movable money safe movably provided between a money safe accommodating position outside a wall structure body constituting an interior of a room and a money safe usable position inside the wall structure body through an opening of the wall structure body, in which the movable money safe is driven at least into the money safe usable position by a drive device.

2. Description of the Prior Art

Various money safes from a personal small-size money safe to business large-size money safe have been conventionally proposed in accordance with intended purposes. The proposed small-size money safe is relatively light in weight and can freely be moved, and is usually accommodated in a closet or the like for example. If a door of the closet is opened when necessary, a door of the money safe can also be opened, and the small-size money safes are widely used for home use and small business use.

On the other hand, the large-size money safe is of stationary type in many cases as can be seen in a bank, and is generally installed in a fireproof structure in a basement. A doorway of the basement is closed with a fireproof door. If the fireproof door is opened, a door of the money safe accommodated in the basement can be opened.

The small-size money safe has a merit that it is light in weight and can be moved easily. However, the small-size money safe is arrestive and almost defenseless. The small-size money safe is constituted of a fireproof structure wall including water therein, as known, and thus, the fireproof effect is deteriorated with time, and it is not always safe against fire. Especially when the small-size money safe is put in a closet or the like, it is subjected to high temperature at the time of fire and thus there is an adverse possibility that bills, bonds and the like in the small-size money safe are burned.

On the other hand, since the large-size money safe is provided in a fireproof structure, this money safe has substantially perfect security measures against fire and burglary. However, its construction cost is expensive, and this money safe is not suitable for home use or a small-scale business use. Further, since the construction cost is expensive, there is inconvenience in that the installation place cannot easily be changed. There is also a defect that the size of the money safe is large and grandiose, and the money safe occupies one room.

SUMMARY OF THE INVENTION

It is an object of the present invention to provide a movable money safe in which the above-described conventional problem and drawback are overcome and more specifically, to provide a movable money safe which is safe against burglary, fire, and the like, and which is inexpensive and can easily be utilized when necessary. The movable money safe is not limited, but is suitably for home use or relatively small-scale business use.

The above objection of the present invention is achieved by a structure in which the money safe can be moved between a money safe accommodating position where public attention is not drawn easily and the money safe is relatively safe against fire and a money safe usable position where the money safe can be utilized by opening a door, and the money safe is driven at least from the money safe accommodating position to the money safe usable position by running water. In general, a building is provided with a reserved water tank, such as a water supply tank, a fireproof tank. the above object is achieved by utilizing water in such a reserved water tank. If the running water, reserved water, or the like, is utilized, the money safe can be driven even in case of emergency where supply of electricity, gas, or the like, is cut off in life line such as electricity, gas, running water, or the like. To achieve the above object, according to a first aspect of the present invention, there is provided a movable money safe which is movably provided between a money safe accommodating position outside a wall structure body constituting a room interior and a money safe usable position inside the wall structure body through an opening of the wall structure body, and which is driven to the money safe usable position by a drive device, wherein the drive device is constituted of a piston cylinder unit operated by water pressure of running water, reserved water, and the like. According to a second aspect of the invention, when the movable money safe of the first aspect is driven to the money safe accommodating position, the opening of the wall structure body is closed with a closing body, and when the movable money safe of the first aspect is driven to the money safe accommodating position, the opening of the wall structure body is closed with a closing body, and when the movable money safe is driven to the money safe usable position, the closing body is also driven. According to a third aspect of the invention, the closing body of the second aspect is of fireproof structure. According to a fourth aspect of the invention, the money safe accommodating position of any one of the first to third aspects is a basement located below the wall structure body which constitutes the room interior, and the wall structure body is a floor surface. According to a fifth aspect of the invention, the money safe accommodating position of any one of the first to third aspects is a side room outside the wall structure body which constitutes the room interior, and the wall structure body is a side wall. According to a sixth aspect of the invention, a valve for controlling water pressure of running water, reserved water, and the like, to be supplied to the piston cylinder unit of any one of the first to fifth aspects is disposed in other than the room interior which is the money safe usable position. According to a seventh aspect of the invention, there is provided a movable money safe which is movably provided between a money safe accommodating position in a basement located below an opening formed in an outdoor ground surface and a money safe usable position through the opening and on the ground, and which is driven to the money safe usable position by a drive device, wherein the drive device is constituted of a piston cylinder unit operated by water pressure of running water, reserved water and the like. According to an eighth aspect of the invention, when the movable money safe of the eighth aspect is driven to the money safe accommodating position, the opening is closed with a material which is the same as the material of the ground surface in the vicinity of the opening, and when the movable money safe is driven to the money safe usable position, the material is also driven. According to a ninth aspect of the invention, there is provided a movable money safe which is provided between a money safe accommodating position outside a side wall constituting a room interior and a money safe usable position inside the side wall through an opening of the side wall, wherein the money safe additionally includes a closing body for closing the opening, and when the money safe is accommodated in the money safe accommodating position, the closing body closes the opening, and when the money safe is to be moved to the money safe usable position, the closing body is also moved together. According to a tenth aspect of the invention, there is provided a movable money safe which is rotatably accommodated in a money safe accommodating chamber outside an opening of a side wall constituting a room interior, and which can be utilized through the opening if the money safe is rotated to a predetermined position, wherein the money safe additionally includes a closing body which closes the opening, and when the money safe is rotated to a money safe accommodating position, the closing body closes the opening, and when the money safe is rotated to a usable position, the closing body opens the opening.

BRIEF DESCRIPTION OF THE DRAWINGS

FIGS. 1(A) and 1(B) show a first embodiment of the present invention, wherein FIG. 1(A) is a sectional view of an essential portion of the first embodiment, and FIG. 1(B) is a sectional view of a water pressure type piston cylinder unit;

FIGS. 3(A) and 3(B) show a third embodiment of the invention, wherein FIG. 3(A) is a sectional view of an essential portion of the third embodiment, and FIG. 3(B) is a plan view of the embodiment of a drive device.

DESCRIPTION OF THE PREFERRED EMBODIMENTS

Figure 1:
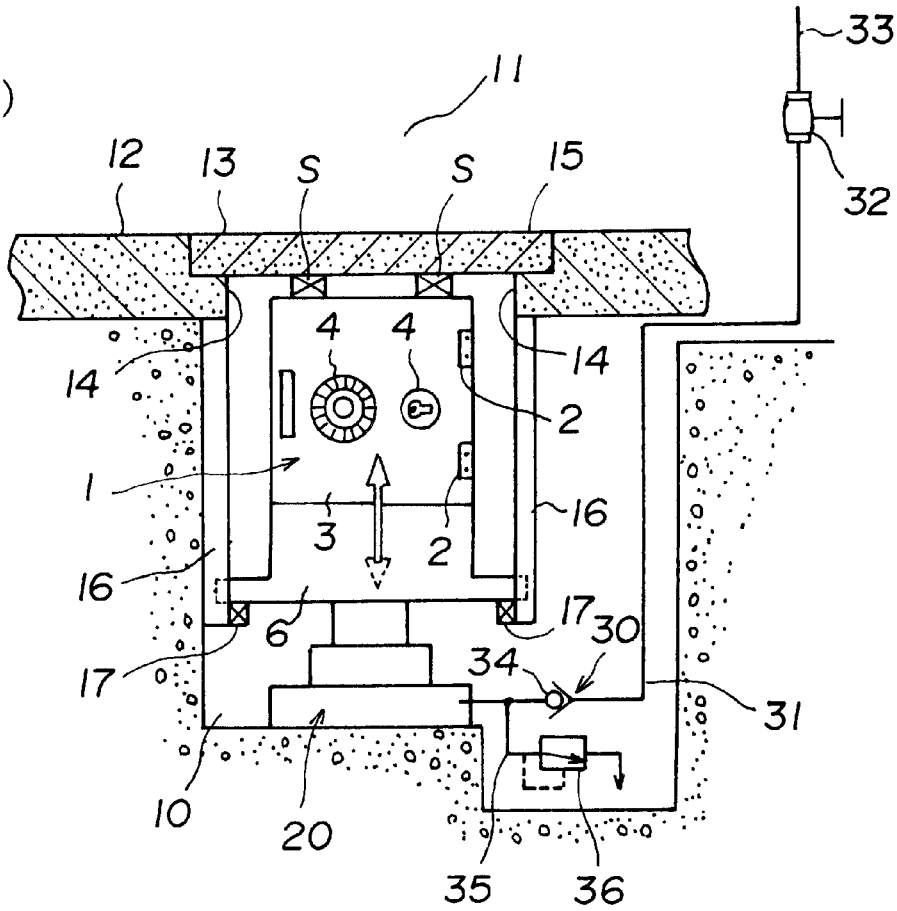
Figure 1:
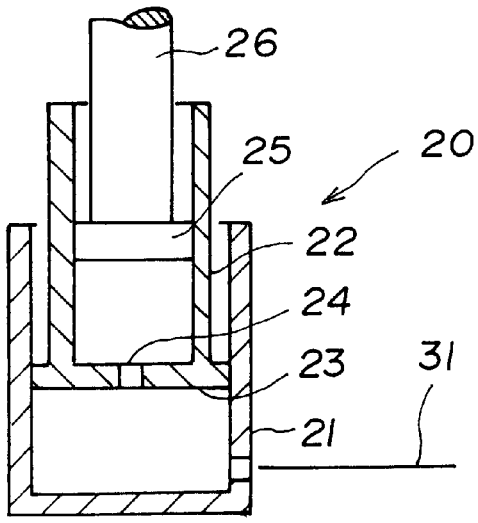

The first to third embodiments of the present invention will be explained with reference to the accompanying drawings below. In a movable money safe 1 of the first embodiment of the invention, its structure itself is also formed into a cube comprising a fireproof wall body as known. The movable money safe 1 is provided at its front surface with an open/close door 3 which is turned On hinges 2 and 2. Therefore, when locks 4 and 4 provided on the open/close door 3 are unlocked, the open/close door 3 can be opened. According to the first embodiment, the movable money safe 1 having such a structure is placed on a light-weight pedestal 6, accommodated in a basement 10, and is driven into a usable room interior 11 above the basement 10.

A floor surface 12 constituting the room interior 11 is constituted of a fireproof structure such adhesives s and s, concrete in this embodiment, and a portion thereof is formed with an opening 13. Support members 14 and 14 are provided around the opening 13. When the opening 13 is closed with a lid 15, the lid 15 is supported by the support members 14 and 14. In this embodiment, the lid 15 is constituted of a fireproof wall body having water therein, and a surface thereof is colored with the same color or is provided with the same design adhesives s and s as that of the floor surface 12. Therefore, if the opening 13 is closed with the lid 15 as shown in FIG. 1(A), the floor surface 12 and the lid 15 can not be distinguished from each other by means of color. A basement 10 having a predetermined volume is formed below the floor surface 12 having a shape corresponding to the lid 15. In the embodiment shown in FIG. 1(A), the lid 15 and an upper wall of the movable money safe 1 are formed by means of adhesives s and s.

In the embodiment shown in FIG. 1(A), a drive device for driving the movable money safe 1 from the basement 10 to an upper room interior 11 together with the pedestal 6 comprises a water pressure type piston cylinder unit 20 and a water-supply device 30 for supplying running water of predetermined water pressure to the water pressure type piston cylinder unit 20.

The water pressure type piston cylinder unit 20 has a telescopic structure. That is, according to an embodiment shown in FIG. 1(B), the water pressure type piston cylinder unit 20 comprises first and second water pressure cylinders 21 and 22. More specifically, the water pressure type piston cylinder unit 20 comprises the first water pressure cylinder 21 fixed to a floor structure of the basement 10 and having a relatively large diameter, the second water pressure cylinder 22 provided in the first water pressure cylinder 21 for reciprocating motion, a piston 25 provided in the second water pressure cylinder 22 for reciprocating motion likewise, and a piston rod 26 which is integrally formed on the piston 25. A bottom of the second water pressure cylinder 22 is formed with a through hole 24, and functions as a piston portion 23. The piston portion 23 comes into close contact with an inner peripheral surface of the first water pressure cylinder 21 and reciprocates. An upper end of the piston rod 26 having the above-described structure is fixed to a lower surface of the pedestal 6. Therefore, if running water is supplied from the water-supply pipe 31, running water which has been supplied to a piston head chamber of the first water pressure cylinder 21 is also supplied to a piston head chamber of the second water pressure cylinder 22 through the through hole 24. With this feature, although rising speed or lifting power and the like of the second water pressure cylinders 23 and the pistons 25 differ because of a difference in pressure-receiving surfaces of the piston 25 and the piston portion 23 of the second water pressure cylinder 22, and because of a difference in volume of the piston head chambers of the piston 25 and the piston portion 23, the piston rod 26 finally rises, and the pedestal 6 and thus the movable money safe 1 is lifted to a predetermined height in the room interior 11.

As shown in FIG. 1(A), the water-supply device 30 includes a water-supply pipe 31. One end of the water-supply pipe 31 is connected to a feed pipe 33 through an open/close valve 32, and the other end is connected to the piston head chamber of the first water pressure cylinder 21 of the water pressure type piston cylinder unit 20 through a check valve 34. A relief pipe 35 is connected between the check valve 34 and the first water pressure cylinder 21. The relief pipe 35 is provided with a relief valve 36 which is opened by a predetermined water pressure. According to this embodiment, the open/close valve 32 is disposed in a kitchen, a toilet, or the like, except the room interior 11. Therefore, it is possible to open the open/close valve 32, supply running water to the water pressure type piston cylinder unit 20 and lift the movable money safe 1 from the basement 10 to the upper room interior 11 without drawing public attention.

The basement 10 is provided with a guide device for guiding the pedestal 6 in the vertical direction and reliably holding the pedestal 6 at the lifted position. Although FIG. 1(A) does not illustrate precisely, the guide device comprises a pair of opposed angle bars 16 and 16. The pair of angle bars 16 and 16 extend from predetermined positions of the basement 10 to lower ends of a floor surface 11. The angle bars 16 and 16 slide and come into contact with corners of the pedestal 6 for guiding the latter. A guide surface of each of the angle bars 16 and 16 is subjected to lining using material having small coefficient of friction such as fluorocarbon resin.

Next, the operation of the first embodiment will be explained. In a state shown in FIG. 1(A), the pedestal 6 is supported by stoppers 17 and 17 provided on lower ends of the angle bars 16 and 16, and an upper surface of the lid 15 is substantially flush with the floor surface 12. The upper surface of the lid 15 has the same color as that of the floor surface 12. Therefore, the upper surface of the lid 15 can be used as in the same manner as the floor surface 12. For example, people can walk on the lid 15. A third party can not see that the movable money safe 1 is accommodated in the basement 10 below the lid 15, there is no need to worry about burglary. Further, the lid 15 is constituted of the fireproof structure, the money safe is safe against fire.

The open/close valve 32 is opened when necessary. With this operation, the running water is supplied from the water-supply pipe 31 to the water pressure type piston cylinder unit 20. The piston rod 26 of the water pressure type piston cylinder unit 22 is driven upward as described above. A spring of the relief valve 36 is set such that the relief valve 36 is not opened with a pressure which drives the movable money safe 1. Thus, the movable money safe 1 is lifted together with the lid 15 to the upper room interior 11. With this, the open/close door 3 of the movable money safe 1 can be opened or closed, and the movable money safe 1 can be used. When the pedestal 6 is driven upward, since the pedestal 6 abuts against lower surfaces of the support members 14 and 14, even if the supply of the running water is continued, the movable money safe 1 stops at a predetermined position. At that time, since the pressure of the running water is relatively low, the water pressure type piston cylinder unit 20, and the like, are not destroyed. If the pressure exceeds the set pressure of the relief valve 36, the relief valve 36 is opened and the elevated pressure water is released and thus, the money safe is safe.

When the movable money safe 1 is accommodated in the basement 10, the open/close valve 32 is closed and the relief valve 36 is opened. With this operation, water pressure in the water pressure type piston cylinder unit 20 is released, the movable money safe 1 and the lid 15 are accommodated in the basement 10 by their own weight as shown in FIG. 1(A). The lid 15 closes the opening 13.

The money safe is accommodated in the following manner. That is, the open/close valve 32 is closed, and the lid 15 which has been fixed to the upper surface of the movable money safe 1 is manually pushed downward. With this operation, the water pressure in the water pressure type piston cylinder unit 20 is increased, and this pressure exceeds the set pressure of the relief valve 36, and the relief valve 36 is opened. Therefore, water in the water pressure type piston cylinder unit 20 is discharged by the amount corresponding to the push-down amount. With this, the money safe is accommodated in the basement 10.

Figure 2:
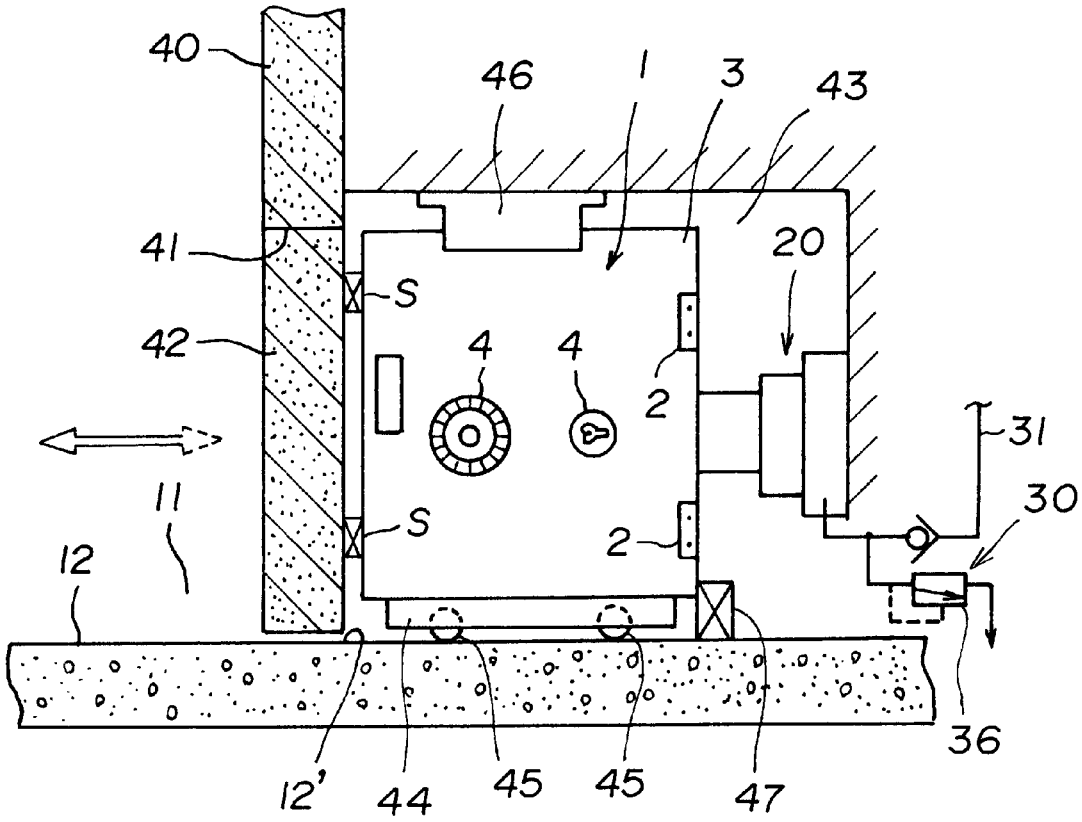
FIG. 2 is a sectional view showing a second embodiment of the invention.

Next, a second embodiment of the present invention will be explained with reference to FIG. 2. The same constituent elements as those in the first embodiment are designated with the same reference numbers or characters, or dash "'" is added to the reference numbers or characters, and the same explanation is omitted. According to the second embodiment, the room interior 11 comprises the floor surface 12 and a side wall 40. The side wall 40 is formed with an opening 41. The opening 41 is closed with a lid 42.

In this embodiment also, the lid 42 is constituted of a fireproof wall body having water therein. A surface of the lid 42 has the same color as that of the side wall 40. Therefore, if the opening 41 is closed with the lid 42 as shown in FIG. 2, the side wall 40 and the lid 42 can not be distinguished by means of color. A money safe accommodating chamber 43 having a predetermined volume is formed on a side of the side wall 40 in correspondence with the lid 42 having the above structure. In this embodiment, the side wall of the lid 42 and the movable money safe 1 are temporarily formed integrally together by adhesives s and s.

The movable money safe 1 is placed on a pedestal 44. The pedestal 44 is provided at its lower portion with wheels 45 and 45 which roll on the floor surface 12 and a floor surface 12' of the money safe accommodating chamber 43. The wheels 45 and 45 roll on the floor surface 12 of the room interior 11 and the floor surface 12' of the money safe accommodating chamber 43 in the horizontal direction. With this, the movable money safe 1 is driven horizontally. The money safe accommodating chamber 43 is provided at its upper wall with a guide member 46 which guides the movable money safe 1. A stopper 47 is provided on the floor surface 12' closest to its rear end. The water pressure type piston cylinder unit 20 is mounted between the side wall of the movable money safe 1 and a rear wall of the money safe accommodating chamber 43.

It is apparent that the second embodiment works substantially in the same manner as the first embodiment. That is, if running water is supplied to the water pressure type piston cylinder unit 20 from a state shown in FIG. 2, the movable money safe 1 is driven together with the lid 42 toward the room interior 11. With this, the movable money safe 1 can be used. If the lid 42 is pushed back manually, the relief valve 36 opens as described above, and the movable money safe 1 is accommodated. In the state in which the movable money safe 1 shown in FIG. 2 is accommodated, the lid 42 is substantially flush with the side wall 40, and the surface of the lid 42 has the same color as that of the side wall 40. Therefore, design effect of the side wall 40 is not deteriorated. Further, since a third party can not see that the movable money safe 1 is accommodated in the money safe accommodating chamber 43 aside of the lid 42, there is no need to worry about burglary. Further, the lid 42 is constituted of the fireproof structure, the money safe is safe against fire. According to the second embodiment, the movable money safe 1 is driven horizontally, and the pedestal 44 is provided with the wheels 45 and 45. Therefore, the movable money safe 1 can be driven manually. It is apparent that even if the movable money safe 1 is driven manually, substantially the same effect as that obtained when the water pressure type piston cylinder unit 20 is applied can be obtained.

Figure 3:
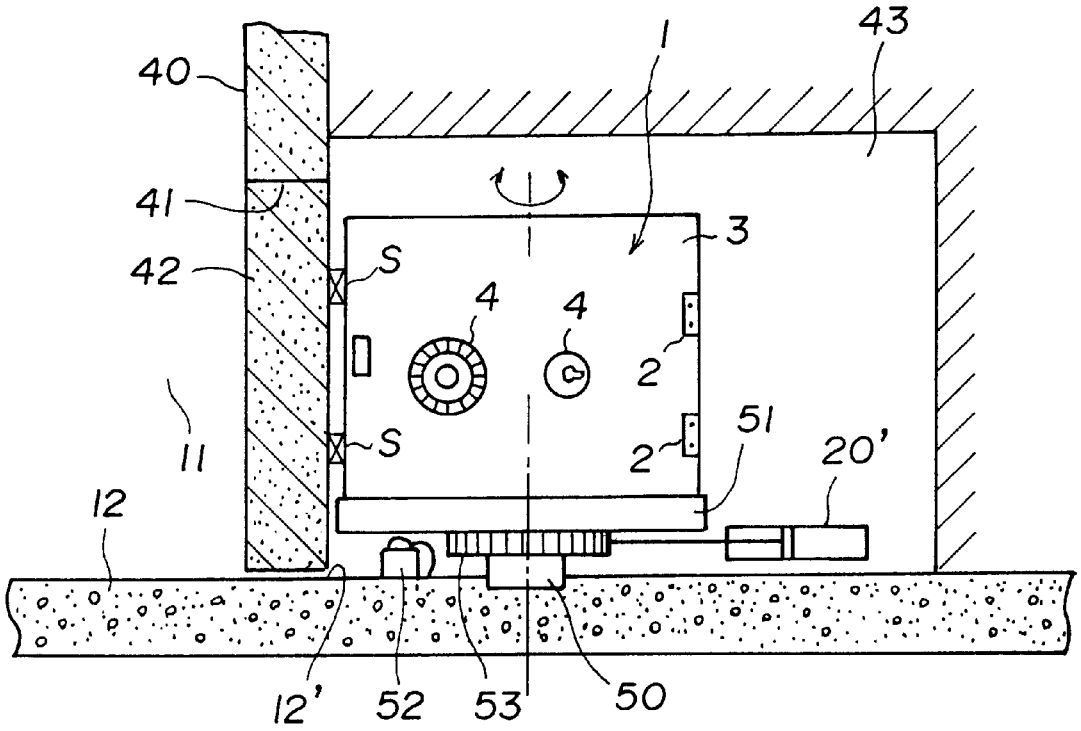
Figure 3:
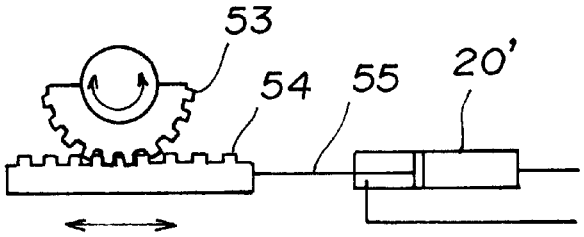

FIGS. 3(A) and (B) show a third embodiment of the present invention. The same constituent elements as those in the first and second embodiments are designated with the same reference numbers or characters, or prime symbol "'" is added to the reference numbers or characters, and the same explanation is omitted. According to the third embodiment, the movable money safe 1 rotates around a vertical shaft 50. That is, a turning table 51 on which the movable money safe 1 is placed is supported by a plurality of supporting balls 52. The positioning vertical shaft 50 is mounted at a center position of a lower surface of the turning table 51. Therefore, the turning table 51 is supported by the plurality of supporting balls 52 and rotates around the vertical shaft 50.

According to the third embodiment, since the turning table 51 is supported by the supporting balls 52, the turning table 51 can be driven manually. That is, in a state shown in FIG. 3(A), the opening 41 of the side wall 40 is closed with the lid 42, and the movable money safe 1 is in the accommodating position where the movable money safe 1 can not be used. If an end of the lid 42 is pushed to turn the same through about 90 degrees, the lid 42 is turned or moved inward of the money safe accommodating chamber 43, and the open/close door 3 of the movable money safe 1 is directed to the opening 41. With this operation, the movable money safe 1 can be used. It is apparent that if the lid is turned reversely, the movable money safe 1 can be accommodated.

The turning table 51 can be driven manually as described above, FIGS. 3 show an embodiment in which the turning table 51 is driven by water pressure such as running water as in the first and second embodiments. That is, according to the third embodiment, the drive device comprises a semicircular pinion 53 mounted to the vertical shaft 50, and a rack 54 meshed with the pinion 53. The rack 54 reciprocates by a rod 55 of a water pressure type piston cylinder unit 20'. Therefore, is running water is supplied to or discharged from the water pressure type piston cylinder unit 20', the rack 54 moves leftward or rightward, and the movable money safe 1 is driven to the accommodating position and the usable position. According to the third embodiment also, it is apparent that the same effect as those of the first and second embodiments can be obtained.

The present invention can be carried out without being limited to the above embodiments. For example, although the basement is provided indoor in the first embodiment, if utilization frequency is low, the basement may be provided in the vicinity of an outdoor pond in a garden, a lantern, a big tree, or the like. If the basement is provided outdoor underground in this manner, the money safe becomes safer against burglar and especially fire. When a water-supply tank is located as a water pressure source at a high position such as a building, if the water-supply pipe 31 is connected to the water-supply tank, even if the running water is stopped, the movable money safe 1 can be driven to the usable position. When a rain water tank, a disaster prevention tank, or the like, is provided, the water-supply pipe 31 can be connected to the tank. If a water pipe to which a water-supply tank, a rain water tank, and the like, is connected to the feed pipe in parallel, the movable money safe 1 can be driven by any of the tanks.

When the movable money safe 1 is heavy, a plurality of water pressure type piston cylinder units can be used. At that time, an orifice, a pressure compensation type flow rate adjusting valve and the like can be provided on branch pipes connected to the plurality of water pressure type piston cylinder units. According to the embodiment, although the running water is supplied to the water pressure type piston cylinder units, water pressure of the running water is not high. The water pressure type piston cylinder unit can be made of reinforced plastic which is not subject to corrosion. In that case, maintenance of the unit is easy.

It is necessary to bring the movable money safe 1 into and back from the basement 10 or the money safe accommodating chamber 43. In that case, an electric drive device may be added to the water pressure type piston cylinder unit, and the electric drive device may be usually used.

Although the lids 15 and, 42 are driven together with the movable money safe 1 in the first and second embodiments, the lids 15 and 42 may be opened and closed manually. At that time, an end of the lid 15 is hinged to the floor surface 12, an end of the lid 42 is hinged to the side wall 40 so that the lids can be opened and closed in a manner of a hinged door.

As described above, the present invention provides a movable money safe which is movably provided between a money safe accommodating position outside a wall structure body constituting a room interior and a money safe usable position inside the wall structure body through an opening of the wall structure body, and which is driven to the money safe usable position by a drive device, wherein the drive device is constituted of a piston cylinder unit operated by water pressure of running water, reserved water and the like. That is, the money safe is usually accommodated in the money safe accommodating position outside the wall structure body. Therefore, the money safe is safe against burglar, fire and the like. Since the drive device is constituted of the piston cylinder unit which is operated with water pressure, the money safe can reliably be utilized only by supplying, to the piston cylinder unit, water which is not stopped even in case of disaster, which is a feature peculiar to the present invention. According to the present invention in which the closing body for closing the opening of the wall structure body is of fireproof structure, effect against fire is enhanced. According to the present invention in which the money safe accommodating position is the basement below the wall structure body, effect not only against fire but also against burglar is enhanced.

What is claimed is:

1. A movable money safe which is movably provided between a money safe accommodating position outside a wall structure body constituting a room interior and a money safe usable position inside said wall structure body through an opening of said wall structure body, and which is driven to said money safe usable position by a drive device, wherein said drive device comprises a piston cylinder unit operated by domestic or tap service water including a fixed first water pressure cylinder having an opening communicating with a source of domestic or tap service water, a first piston movable in said first water pressure cylinder, a second water pressure cylinder integrally formed with said first piston and movable therewith, a through-hole in said first piston establishing fluid communication between the interior of said first water pressure cylinder and said second water pressure cylinder, and a piston movable in said second water pressure cylinder having a piston rod operatively connecting with said money safe for moving said money safe between said money safe accommodating position and said money safe usable position.

2. A movable money safe according to claim 1, wherein when said movable money safe is driven to the money safe accommodating position, the opening of said wall structure body is closed with a closing body, and when the movable money safe is driven to the money safe usable position, said closing body is also driven.

3. A movable money safe according to claim 2, wherein said closing body is of fireproof structure.

4. A movable money safe according to any one of claims 1 to 3, wherein said money safe accommodating position is a basement located below the wall structure body which constitutes the room interior, and said wall structure body is a floor surface.

5. A movable money safe according to any one of claims 1 to 3, wherein said money safe accommodating position is a side room outside the wall structure body which constitutes the room interior, and said wall structure body is a side wall.

6. A movable money safe according to any one of claims 1 to 3, wherein a valve for controlling water pressure of running water, reserved water and the like to be supplied to the piston cylinder unit is disposed in other than the room interior which is the money safe usable position.

7. A movable money safe which is movably provided between a money safe accommodating position in a basement located below an opening formed in an outdoor ground surface and a money safe usable position through the opening and on the ground, and which is driven to said money safe usable position by a drive device, wherein said drive device comprises a piston cylinder unit operated by domestic or tap service water including a fixed first water pressure cylinder having an opening communicating with a source of domestic or tap service water, a first piston movable in said first water pressure cylinder, a second water pressure cylinder integrally formed with said first piston and movable therewith, a through-hole in said first piston establishing fluid communication between the interior of said first water pressure cylinder and said second water pressure cylinder, and a piston movable in said second water pressure cylinder having a piston rod operatively connecting with said money safe for moving said money safe between said money safe accommodating position and said money safe usable position.

8. A movable money safe according to claim 7, wherein when said movable money safe is driven to the money safe accommodating position, the opening is closed with a material which is the same as a ground surface in the vicinity of the opening, and when the movable money safe is driven to the money safe usable position, said material is also driven.

* * * * *